US009044868B2

(12) United States Patent
Eichhorn et al.

(10) Patent No.: US 9,044,868 B2
(45) Date of Patent: Jun. 2, 2015

(54) CUTTING HEAD FOR AN ELECTRIC RAZOR

(75) Inventors: Reinhold Eichhorn, Idstein (DE); Andreas Hartmann, Schwalbach (DE); Peter Junk, Schmitten (DE); Joachim Krauss, Pfungstadt (DE); Michael Odemer, Niddatal (GE); Andreas Peter, Kronberg (DE); Thorsten Pohl, Muehlheim (DE); Markus Sabisch, Waldems (DE); Tobias Schwarz, Schmitten (DE); Thomas Verstege, Frankfurt (DE); Juergen Wolf, Kriftel (DE); Christoph Zegula, Roedermark (DE)

(73) Assignee: Braun GmbH, Kronberg (DE)

( * ) Notice: Subject to any disclaimer, the term of this patent is extended or adjusted under 35 U.S.C. 154(b) by 347 days.

(21) Appl. No.: 13/034,868

(22) Filed: Feb. 25, 2011

(65) Prior Publication Data

US 2011/0209350 A1 Sep. 1, 2011

Related U.S. Application Data

(63) Continuation of application No. PCT/EP2009/006352, filed on Sep. 2, 2009.

(51) Int. Cl.
*B26B 19/02* (2006.01)
*B26B 19/04* (2006.01)

(52) U.S. Cl.
CPC ..... *B26B 19/042* (2013.01)

(58) Field of Classification Search
CPC ..... B26B 19/042; B26B 19/12; B26B 19/28
USPC ..... 30/43.9, 43.92, 346.51; D28/51
See application file for complete search history.

(56) References Cited

U.S. PATENT DOCUMENTS

| | | | | | |
|---|---|---|---|---|---|
| 2,223,156 | A | * | 11/1940 | Benner | 30/43.92 |
| 2,266,885 | A | * | 12/1941 | Martin | 30/43.92 |
| 2,331,274 | A | * | 10/1943 | Martin | 30/43.92 |
| 2,591,403 | A | * | 4/1952 | Carissimi | 30/43.92 |

(Continued)

FOREIGN PATENT DOCUMENTS

| | | | | |
|---|---|---|---|---|
| CN | 2298912 | Y | | 12/1998 |
| CN | 101096103 | A | | 1/2008 |
| DE | 1927032 | | | 6/1970 |
| DE | 20 26 509 | A1 | | 12/1970 |
| DE | 297 14 055 | U1 | | 10/1997 |
| DE | 10 2008 046 072 | | * | 3/2010 |
| EP | 1607196 | | * | 12/2005 |
| GB | 1294918 | | * | 7/1970 |
| GB | 2444620 | | * | 6/2008 |
| JP | 2000-157755 | A | | 6/2000 |
| WO | WO 03/059584 | A1 | | 7/2003 |

OTHER PUBLICATIONS

European Search Report for PCT/EP2009/006352 dated Dec. 17, 2009.

*Primary Examiner* — Hwei C Payer
(74) *Attorney, Agent, or Firm* — Jay A. Krebs; Brent M. Peebles

(57) ABSTRACT

A cutting head for an electric razor is provided. The cutting head has at least one upper blade and a lower blade associated with the upper blade, which upper and lower blades are movably supported relative to one another and can be driven accordingly by a drive device. The upper blade has a contact surface for the skin to be shaved, which contact surface is formed by a plurality of webs that are each bounded by slots. The longitudinal extent of the webs runs substantially perpendicular to a threading edge bounding the contact surface. The contact surface is designed to be concave and rises towards the threading edge, where the threading edge has an outer radius and this outer radius encloses an angle of less than 90°.

10 Claims, 4 Drawing Sheets

(56) References Cited

U.S. PATENT DOCUMENTS

| | | | | | |
|---|---|---|---|---|---|
| 2,915,816 | A | * | 12/1959 | Gray | 30/43.92 |
| 3,001,282 | A | | 9/1961 | Pinkas | |
| 3,103,743 | A | * | 9/1963 | Kobler et al. | 30/34.2 |
| 4,493,149 | A | * | 1/1985 | Tanahashi et al. | 30/43.92 |
| 4,807,365 | A | * | 2/1989 | Bertram et al. | 30/346.51 |
| 5,893,211 | A | * | 4/1999 | Hotani | 30/43.92 |
| D430,352 | S | * | 8/2000 | Packham et al. | D28/51 |
| 6,357,117 | B1 | * | 3/2002 | Eichhorn et al. | 30/43.92 |
| 7,024,775 | B2 | * | 4/2006 | Uchiyama | 30/43.92 |
| 7,065,878 | B2 | * | 6/2006 | Uchiyama | 30/43.6 |
| 2004/0163260 | A1 | * | 8/2004 | Uchiyama | 30/43.92 |
| 2004/0172830 | A1 | * | 9/2004 | Uchiyama | 30/43.92 |
| 2005/0274019 | A1 | | 12/2005 | Inque et al. | |
| 2008/0040935 | A1 | * | 2/2008 | Gratz | 30/539 |

* cited by examiner

CUTTING HEAD FOR AN ELECTRIC RAZOR

CROSS REFERENCE TO RELATED APPLICATIONS

This application is a continuation of prior co-pending International Application No. PCT/EP2009/006352 filed Sep. 2, 2009, designating the United States.

FIELD OF THE INVENTION

The invention relates to a cutting head for an electric razor.

BACKGROUND OF THE INVENTION

Cutting heads for electric razors are known, for example, see DE-C 1927032. During the shaving process, the hairs to be shorn are threaded through the slots of the upper blades of such cutting heads and are shorn by the lower blade moving relative to the upper blade, which lower blade is likewise provided with slots, or with cutting teeth. Known cutting heads of this type have flat contact surfaces, which has a disadvantageous effect on the capability to thread in hairs. Another cutting head is known from U.S. Pat. No. 2,331,274. Although this cutting head has a contact surface that is formed slightly concave, due to the inwardly curving bead in each of the two side walls the angle enclosed by the two outer radii is a markedly obtuse angle. This is disadvantageous for the threading behavior of hairs. Furthermore, the slots taper towards the middle along the contact surface. During a shaving pass this can easily lead to a beard hair becoming caught and being pulled out. The acutely angled design of the groove base of the slots in the side walls leads to the same disadvantageous effect, since here as well hairs can undesirably very easily become caught and plucked, which leads to skin irritation and therefore is disadvantageous with regard to skin-friendliness.

Furthermore, also known are threading means provided in front of the threading edge, as well as threading teeth extending the webs; however, it has been shown that hairs once they are threaded by these means usually then escape from the threading slot, with the result that they cannot be cut. This has a disadvantageous effect on the shaving performance, that is to say that either the thoroughness of the shave markedly decreases or significantly more passes must be made with the electric razor in order to arrive at a good shaving result.

It is therefore the aim of the invention to create a cutting head of the type mentioned above that enables a particularly thorough shave and has a particularly efficient shaving performance but ensures excellent skin-friendliness.

This aim is achieved by the cutting head of the present invention. Owing to the solution according to the invention, by means of the concavity of the contact surface and the exposed position of the web ends associated with the threading edge—that is to say the comb tips—it is ensured that even hairs that are difficult to grasp are threaded into the slots, are guided there and cannot escape until they are cut. The exposed position of the comb teeth thereby promotes the threading, and the concave inner radius of the contact surface ensures that the skin—and therefore the hair to be shaved—cannot lift away from the contact surface, and therefore away from the slot between the webs. For optimal skin friendliness during the shaving process the threading edge is provided with an outer radius. Since, according to the invention, this outer radius encompasses an angle of less than 90°, hairs can be threaded in extremely well during the shaving pass over the skin.

A preferred embodiment of the invention provides that the thickness of the webs as measured perpendicular to the contact surface increases towards the threading edge. The greater thickness in the region of the comb tips provides for an increased skin friendliness since the contact pressure between cutting head and skin is greatest in this exposed region, and therefore the skin in this region can be pushed relatively far into the slots. The increased thickness in this region prevents the skin from being in the actual cutting region, that is to say in the region in which the upper and lower blade are moved relative to one another in a manner sliding on one another, and their contact surfaces form the shearing zone. The contact surface preferably has two threading edges and rises towards both threading edges. In particular, in this embodiment the thickness of the webs as measured perpendicular to the contact surface also increases towards both threading edges.

An additional embodiment of the invention provides that the upper and lower blade are driven linearly oscillating relative to one another, and the threading edge runs substantially parallel to the oscillation direction.

If the groove base of the slots is designed rounded in the shape of an arc, it is ensured that no hairs become caught in this region and are painfully pulled during a shaving pass. If the concave contact surface has an inner radius, a smooth transition from the threading edge can be implemented, which benefits the contact with the skin during the shaving pass.

The contact surface is advantageously designed to be convex relative to an axis running perpendicular to the threading edge, as a result of which so-called problem zones such as skin folds or neck regions can be shaved more easily and thoroughly.

BRIEF DESCRIPTION OF THE DRAWINGS

Additional objectives, features, advantages and possible applications of the present invention will become apparent from the following description of an exemplary embodiment. All described or depicted features, alone or in any combination, form the subject matter of the invention, irrespective of their summarization in the Claims or their dependencies.

The description follows below, accompanied by the drawings, in which.

Figure 1:
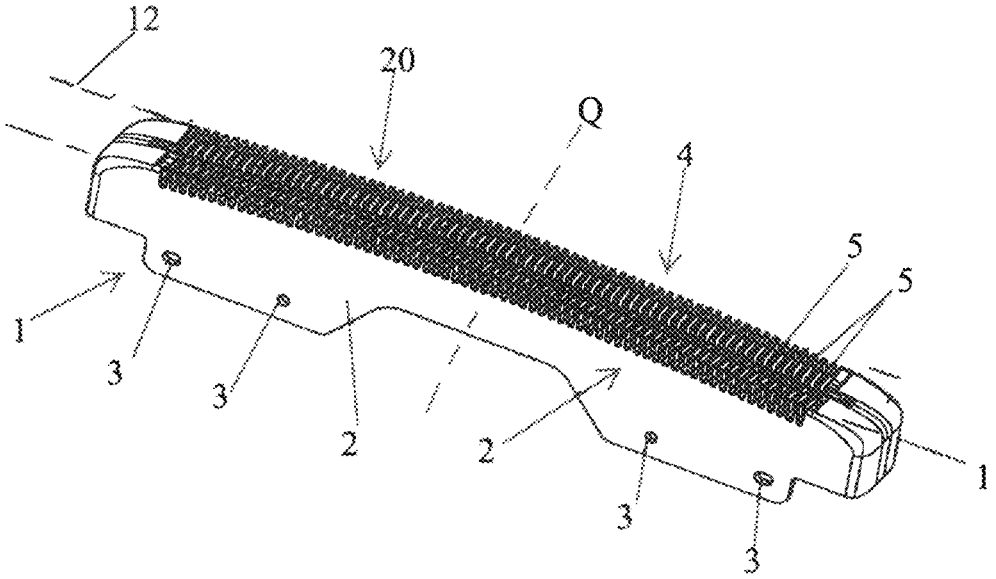
FIG. 1 shows a cutting head according to the invention in a perspective illustration.

The cutting head shown in FIG. 1 can be used either as a single cutting element of an electric razor or can be part of a multiple cutting system. In particular, it is used within a triple cutting system and is used as a middle blade which is arranged between two foil cutting elements. In order to provide the connection to these foil cutting elements, the lateral wall section 2 of the upper blade 1 has a plurality of openings 3. The surface shown facing upward in FIG. 1 of the substantially bar-shaped cutting head forms the contact surface 4 that is formed by a multiplicity of webs running in the transverse direction Q, which webs are separated from one another by slots 6.

Arranged within the upper blade 1 is a lower blade 7 that is provided in the contact region with the upper blade 1 with a plurality of teeth 8 running in the transverse direction Q, which together with the associated edges of the webs 5 form the cutting edges of the cutting head in a manner known per se. On its lower section the lower blade 7 has a receptacle 10 to engage with a drive element which drives the lower blade 7 so that it oscillates in the direction of the longitudinal axis L.

The embodiment of the cutting head according to the invention that is shown in the Figures is designed symmetrically relative to the central longitudinal and transverse axes Q and L and has altogether two contact surfaces 4 arranged parallel to one another, each of which has an associated row of teeth 8, the teeth 8 of the two rows of teeth that are offset from one another by 90° relative to the support wall facing outward, away from one another. Each of the two contact surfaces 4 is thus associated with one of two cutting systems 20, 21 situated parallel to one another, each cutting system in turn having one of the rows of teeth 8. The lower blade is elastically prestressed against the upper blade in a known manner by spring means that are not shown in the drawings. As a result, the upper blade 1 and lower blade 7 are always engaged prestressed in sliding contact with one another during operation of the shaver.

To perform a shaving operation, the cutting head is advanced in the transverse direction Q, whereby the hairs to be shaved are threaded into the slots 6 between the webs 5 in the region of the threading edge 12 which runs parallel to the longitudinal axis L. During the further advancing motion of the cutting head these hairs are then fed in a guided manner in the slots 6 to the cutting region, that is to say the region in which the lower blade 6 is in contact with the webs 5 of the upper blade 1, and are shorn there by cutting edges of the webs 5 or teeth 9 that are associated with one another.

Figure 3:
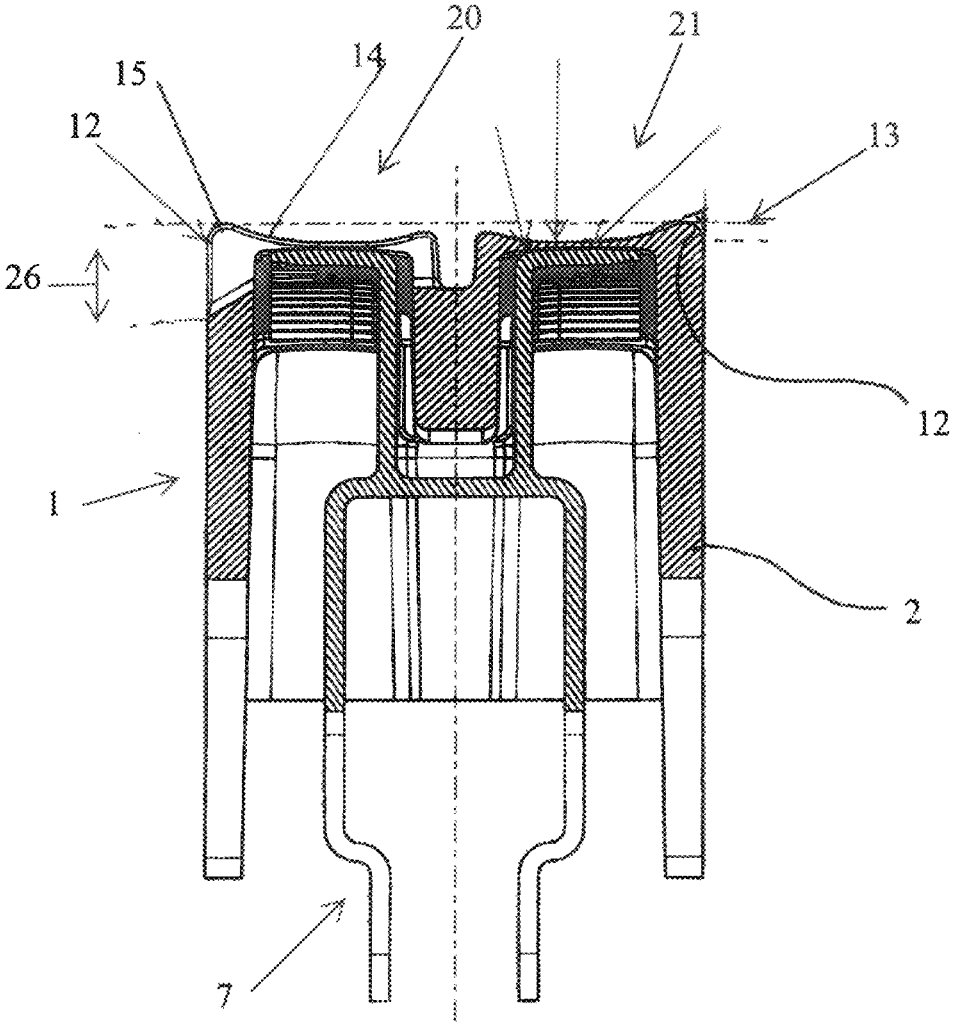

As can be seen in particular from FIG. 3, the contact surface 4 has a contour that is designed to be concave in cross section Q. Relative to the upper boundary plane 13, which is defined by the maximum height of the upper blade 1 in the region of the threading edge 12, it decreases inward in height along an inner radius 14. The thickness of the webs 5 as measured perpendicular to the contact surface 4 also decreases from the maximum thickness in the region of the threading edge 12 to a minimum thickness in the cutting region, that is to say the contact region between the upper blade and lower blade at which the hairs are cut. This decrease H amounts to between 0.01 mm and 1.0 mm. In the region of the threading edge 12 the webs have an outer radius 15 that amounts to approximately 0.01 mm to maximally 0.5 mm. The outer radius 15 connects the concave contact surface 4 to the lateral wall section 2 running vertically. The outer radius 15 of the threading edge 12 terminates on the vertical lateral wall section 2 and transits directly to the concave contact surface 4 shown in FIG. 3. The outer radius 15 encloses an acute angle W, that is to say an angle less than 90°, which is measured at the intersection point of a line parallel to the vertical lateral wall section 2 and a tangent at the concave contact surface 4. Due to this acute angle, upon pressing against the skin during a shaving pass, the contact pressure in the region of the outer radius 15 is increased and, combined with the movement relative to the skin, a roll of skin is formed which is capable of lifting the hair to be shaved and thereby promotes or assists the threading into the slot.

The total height 26 of the threading slots, measured in the lateral wall section 2, amounts to approximately 1 mm; hairs up to this length can thereby be threaded in without being set at an angle during the threading process. They then no longer tend to escape from the slot during the subsequent guidance to the actual cutting point.

The spacing of the upper blade 1, i.e. the separation T between two web center lines 16, amounts to approximately 0.55 mm. This results in a very slender cutting system. The web width 17 amounts to approximately 0.25 mm, resulting in a slot width 18 of approximately 0.30 mm. This narrow slot width 18 prevents skin from being threaded in and possibly being cut or at least irritated. The small web width 17 prevents the hairs from being folded towards the skin during the advancing movement of the cutting head on the skin and not being threaded in and subsequently cut; it thus prevents the so-called "flattening" and sliding over hairs. The slot/web width ratio of 0.3 to 0.25 in favor of the slot width guarantees an optimal threading in of hairs.

At the thinnest point S (see FIG. 3) in the cutting region the web thickness is approximately 0.06 mm. As a result, hairs can not only be shortened but can also be shaved off particularly thoroughly.

Figure 4:
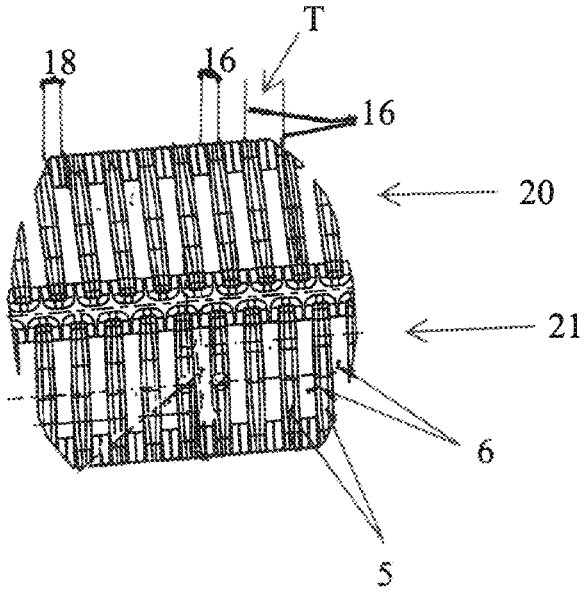
FIG. 4 shows, in an enlarged illustration, the plan view of a cutting head according to the invention or its contact surface formed by webs.
Figure 2:
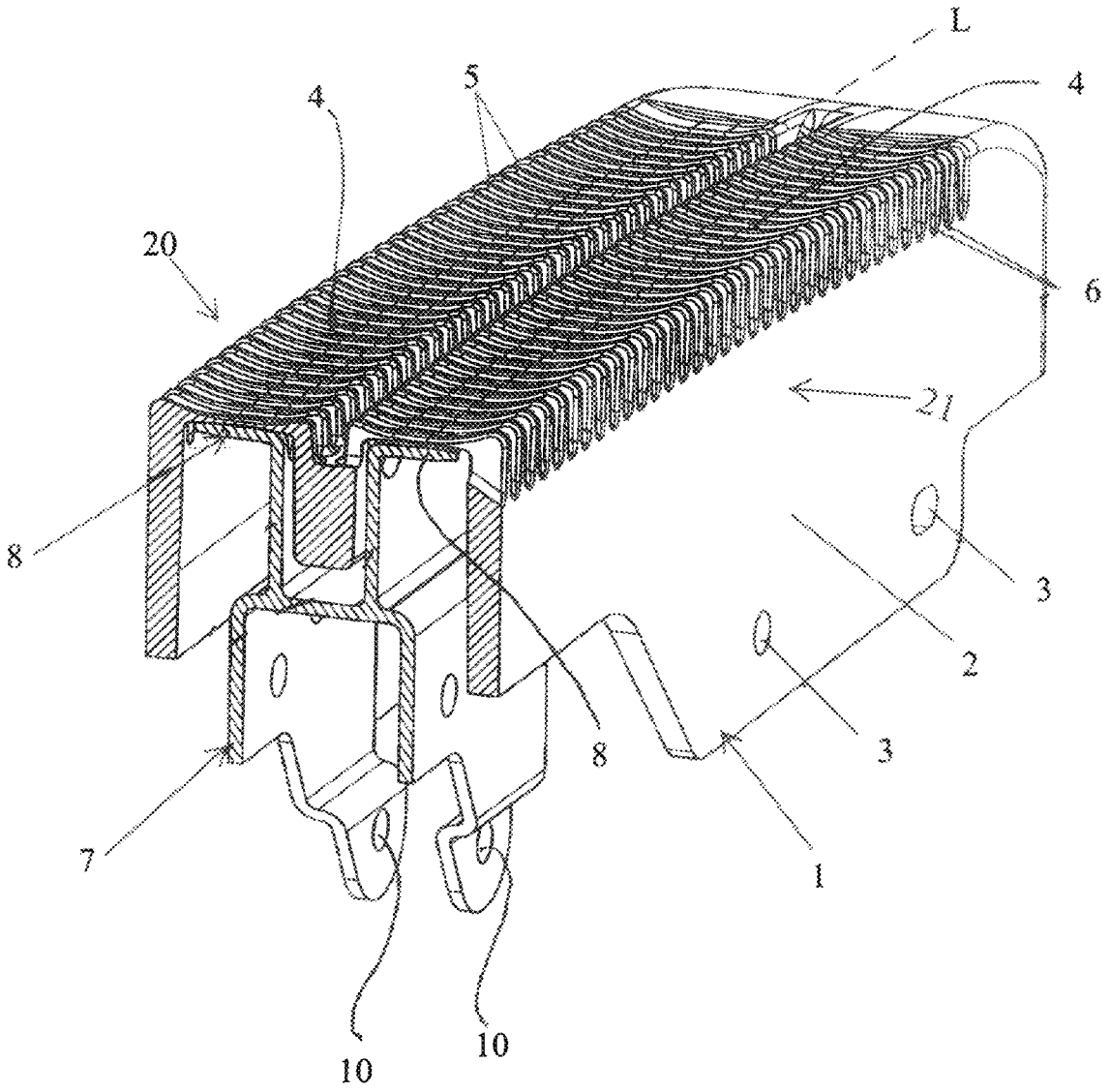
FIG. 2 shows a cutting head according to FIG. 1 in cross section as a perspective illustration, FIG. 3 also shows a cross section through the cutting head according to the invention.

As shown in FIG. 4, the two cutting systems 20, 21 situated parallel to one another are arranged offset from one another by half a separation T, that is to say by approximately 0.275 mm in the longitudinal direction L. This has the result that hairs that were situated precisely in the region of one of the webs 5 during a shaving pass and could not be threaded in and cut, can be threaded in through the webs of the subsequent cutting system, that is to say the second cutting system 20 or 21 in the direction of the pass—depending on the direction of the pass—due to the offset in the coverage by the webs, since a slot 6 also follows each web 5 as viewed in the transverse or pulling direction Q. With the arrangement of two cutting systems 20, 21 offset one behind the other, the chance of the cutting head threading in, feeding and cutting a hair is thus doubled. The slots 6—and therefore also the webs 5—can run perpendicular to the threading edge 12 (see FIG. 6); however, as shown in FIG. 4, they can also have an inclination of a few degrees, in particular of 2°-10° relative to the threading edge 12. This improves the running properties of an associated lower blade 7 the cutting edges of which run perpendicular to the oscillation direction.

As can be seen from FIG. 1, the contact surface (4) is designed to be convex relative to the central transverse axis (Q) running perpendicular to the threading edge (12).

Figure 5:
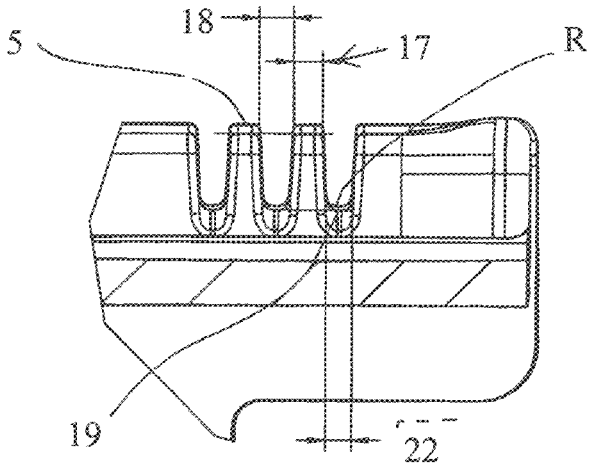
FIG. 5 shows, in an enlarged illustration, a side view of a cutting head according to the invention.

FIG. 5 clarifies that the width of the slots 6 that amounts to a constant slot width 18 of approximately 0.30 mm along the contact surface 4 tapers to a somewhat smaller dimension 22 of 0.23 mm towards the groove base 19 along the lateral wall section 2.

Figure 6:
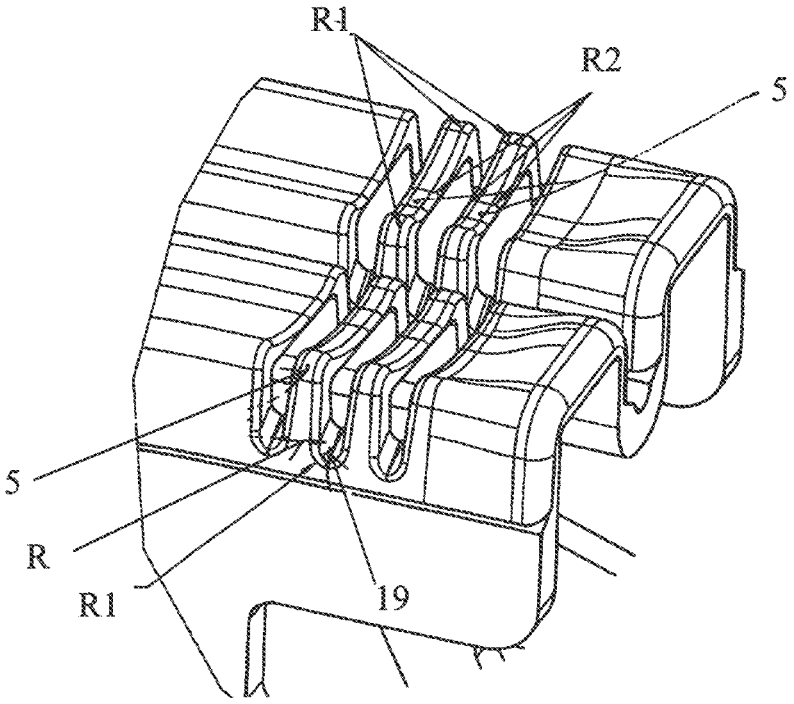
FIG. 6 shows, also enlarged, a perspective illustration of the cutting head according to the invention.

In FIG. 6 it is very clearly apparent that the webs 5 are designed rounded along their extent perpendicular to the threading edge 12, that is to say along their profile parallel to the transverse extent Q. The rounding is executed so as to be nearly continuous, with a radius R1 of 0.08 mm; only in the region of the thinnest web thickness S is the rounding provided with a smaller radius R2 of 0.04 mm. In FIG. 5 in particular, it can be seen that the groove base 19 is rounded by means of the radius R of 0.1 mm. These roundings, as well as the slot width 18 that is constant along the contact surface 4 and the rounding of the groove base 19, markedly reduce the risk that hairs are plucked during the shaving pass.

What is claimed is:

1. A cutting head for an electric razor having at least one upper blade and a lower blade associated with the upper blade, which lower blade is movable relative to the upper blade, wherein the upper blade has a contact surface for the skin to be shaved, which contact surface is formed by a plurality of webs that are each bounded by slots, and the longitudinal extent of the webs runs substantially perpendicular to a threading edge bounding the contact surface, the contact surface is designed to be concave and rises towards the threading edge, wherein the threading edge has an outer radius; and wherein the upper blade has a vertical lateral wall section, and the outer radius of the threading edge terminates on the lateral wall section and transits directly to the concave contact surface, the outer radius encloses an angle measured at the intersection point of a line parallel to the vertical lateral wall section and a tangent at the concave contact surface of less than 90°, and further, wherein the contact surface is designed to be convex relative to an axis running perpendicular to the threading edge.

2. A cutting head according to claim 1, wherein the thickness of the webs, as measured perpendicular to the contact surface, increases towards the threading edge.

3. A cutting head according to claim 1, wherein the contact surface has two threading edges and rises towards both threading edges.

4. A cutting head according to claim 1, wherein the contact surface has two threading edges, and further, wherein the thickness of the webs, as measured perpendicular to the contact surface, increases towards both threading edges.

5. A cutting head according to claim 1, wherein the lower blade is driven linearly oscillating relative to the upper blade, and the threading edge runs substantially parallel to the oscillation direction.

6. A cutting head according to claim 1, wherein each slot has a groove base, and the groove base of the slots is rounded in an arc shape by means of at least one radius.

7. A cutting head according to claim 1, wherein the concave contact surface has an inner radius.

8. A cutting head according to claim 1, wherein at least two cutting systems are provided parallel to one another and to the longitudinal axis.

9. A cutting head according to claim 8, wherein the cutting systems are offset from one another along the longitudinal axis.

10. A cutting head according to claim 9, wherein the cutting systems are offset from one another by half of the separation of the upper blade.

* * * * *